US008144059B2

(12) United States Patent
Lynch

(10) Patent No.: US 8,144,059 B2
(45) Date of Patent: Mar. 27, 2012

(54) ACTIVE DIELECTRIC RESONATOR ANTENNA

(75) Inventor: Jonathan J. Lynch, Oxnard, CA (US)

(73) Assignee: HRL Laboratories, LLC, Malibu, CA (US)

( * ) Notice: Subject to any disclaimer, the term of this patent is extended or adjusted under 35 U.S.C. 154(b) by 324 days.

(21) Appl. No.: 10/848,672

(22) Filed: May 18, 2004

(65) Prior Publication Data

US 2004/0263422 A1 Dec. 30, 2004

Related U.S. Application Data

(60) Provisional application No. 60/483,319, filed on Jun. 26, 2003.

(51) Int. Cl.
*H01Q 1/38* (2006.01)

(52) U.S. Cl. ..... 343/700 MS; 343/767

(58) Field of Classification Search ..... 343/700 MS, 343/719, 789, 767, 911 R; 324/338
See application file for complete search history.

(56) References Cited

U.S. PATENT DOCUMENTS

| | | | | |
|---|---|---|---|---|
| 3,028,488 | A * | 4/1962 | Hudspeth et al. | 455/23 |
| 4,651,100 | A * | 3/1987 | Janes | 324/338 |
| 4,736,454 | A * | 4/1988 | Hirsch | 455/129 |
| 4,916,457 | A * | 4/1990 | Foy et al. | 343/770 |
| 5,087,922 | A | 2/1992 | Tang et al. | 343/853 |
| 5,453,754 | A * | 9/1995 | Fray | 343/789 |
| 5,903,239 | A | 5/1999 | Takahashi et al. | 343/700 MS |
| 6,037,911 | A | 3/2000 | Brankovic et al. | 343/700 MS |
| 6,045,712 | A * | 4/2000 | Yarbrough et al. | 216/2 |
| 6,143,680 | A * | 11/2000 | Okawa | 501/136 |
| 6,198,450 | B1 * | 3/2001 | Adachi et al. | 343/753 |
| 6,249,242 | B1 | 6/2001 | Sekine et al. | 343/700 MS |
| 6,268,796 | B1 * | 7/2001 | Gnadinger et al. | 340/572.5 |
| 6,292,141 | B1 * | 9/2001 | Lim | 343/700 MS |
| 6,307,510 | B1 | 10/2001 | Taylor et al. | 343/700 MS |
| 6,313,797 | B1 | 11/2001 | Kurita et al. | 343/700 MS |
| 6,323,808 | B1 | 11/2001 | Heinrichs et al. | 343/700 MS |
| 6,323,824 | B1 * | 11/2001 | Heinrichs et al. | 343/846 |
| 6,384,785 | B1 | 5/2002 | Kamogawa et al. | 343/700 MS |
| 6,407,718 | B2 * | 6/2002 | Adachi et al. | 343/878 |
| 6,518,932 | B1 * | 2/2003 | Matsui et al. | 343/770 |
| 6,628,230 | B2 * | 9/2003 | Mikami et al. | 342/175 |
| 6,809,688 | B2 | 10/2004 | Yamada | |
| 6,879,287 | B2 * | 4/2005 | Popov et al. | 343/700 MS |
| 7,619,567 | B2 | 11/2009 | Lynch | |
| 2001/0015683 | A1 | 8/2001 | Mikami et al. | 333/134 |

FOREIGN PATENT DOCUMENTS

JP 2000-059140 2/2000

OTHER PUBLICATIONS

U.S. Appl. No. 10/862,043, filed Jun. 3, 2004, Lynch et al.

(Continued)

*Primary Examiner* — Jacob Y Choi
*Assistant Examiner* — Jimmy Vu
(74) *Attorney, Agent, or Firm* — Ladas & Parry

(57) ABSTRACT

A dielectric resonator antenna that has active components on a selected surface. Also a feed element in the form of a slot may be formed on the surface to efficiently generate the proper resonance mode within the bulk of the dielectric resonator antenna. The entire dielectric resonator antenna may be flip-chip mounted onto a suitable microwave substrate.

25 Claims, 2 Drawing Sheets

OTHER PUBLICATIONS

Dorris, R., et al., "Mutual Coupling Between Probe-Fed Dielectric Resonator Antennas," INTERNET: <http://www.egr.uh.edu/uhecereu/Rdabstract.html 1 page total (2001).

"Design of Low-Profile DR Antennas," INTERNET: <http://www.elec.mq.edu.au/research/electronmag/antenna1/antl_abs.html> pp. 1-2 (Feb. 26, 2002).

Esselle, K.P., "A Low-Profile Rectangular Dielectric-Resonator Antenna," *IEEE Transactions on Antennas and Propagation*, vol. 44, No. 9, pp. 1296-1297 (Sep. 1996).

McAllister, M.W., et al., "Rectangular Dielectric Resonator Antenna," *Electronics Letters*, vol. 19, No. 6, pp. 218-219 (Mar. 17, 1983).

Petosa, A., et al., "Design and Analysis of Multisegment Dielectric Resonator Antennas," *IEEE Transactions on Antennas and Propagation*, vol. 48, No. 5, pp. 738-742 (May 2000).

Robertson, I.D., "Millimeter-Wave Back-Face Patch Antenna for Multilayer MMICs," *Electronics Letters*, vol. 29, No. 9, pp. 816-818 (Apr. 29, 1993).

"Dielectric resonator." *Wikipedia, The Free Encyclopedia*. Jun. 5, 2009, <http://en.wikipedia.org/wiki/Dielectric_resonator>.

"Dielectric Resonator Antenna." *Wikipedia, The Free Encyclopedia*. Jun. 5, 2009, <http://en.wikipedia.org/wiki/Dielectric_Resonator_Antenna>.

"Rectangular Dielectric Resonator Antenna" Electronic Letters, Mar. 17, 1983, vol. 19 No. 6.

"Dielectric Resonator Antenna Using Aperture Coupling" *Electronic Letters*, Nov. 22, 1980, vol. 26, No. 24.

Dictionary.com: "Dielectric: a nonconducting substance; insulator." "Dielectric." *Dictionary.com Unabridged* (v 1.1). Random House, Inc. Mar. 23, 2009. <Dictionary.com http://dictionary.reference.com/browse/dielectric>.

Excerpt of "Dielectric Resonators", second edition, 1998, *Noble Publishing Company*.

R. D. Richtmyer. "Dielectric Resonators," Stanford University, California, Journal of Applied Physics, vol. 10, Jun. 1939, pp. 391-398.

Rajesk K. Mongla and Prakash Bhartia, "Dielectric Resonator Antennas—A Review and General Design Relations for Resonant Frequency and Bandwidth", International Journal of Microwave and Millimeter-Wave Computer-Aided Engineering, vol. 4, No. 3, 1994, pp. 230-247.

* cited by examiner

ACTIVE DIELECTRIC RESONATOR ANTENNA

CROSS REFERENCE TO RELATED APPLICATION

This application claims the benefit of U.S. Provisional Patent Application No. 60/483,319 filed Jun. 26, 2003, the disclosure of which is hereby incorporated herein by reference.

FIELD OF INVENTION

The invention relates to dielectric resonator antennas.

BACKGROUND

Existing dielectric resonator antennas do not incorporate active devices within or mounted directly on the physical antenna element. Instead they integrate active devices off the antenna, for example, by using a microstrip path and/or a slot. That is, active electronics and antenna elements are connected, side by side. When the antenna is located on the chip next to the active electronics, the chip itself can adversely affect antenna performance due to the presence of wire bonds, microwave substrates, solder bumps, etc.

The prior includes:

(1) McAllister, Long, Conway "Rectangular dielectric resonator antenna," *Electron. Lett,* vol 19, March 1983;

(2) Esselle, "A low profile rectangular dielectric resonator antenna," *IEEE Trans on Ant. and Prop.*, vol. 44, September 1996;

(3) Petosa, Simons, Siushansian, Ittipiboon, Cuhaci, *IEEE Trans on Ant. and Prop.*, vol. 48, May 2000;

(4) Roberson, I. D. "Millimeter Wave Back Face Patch Antenna for Multilayer MMICs" *Electron. Lett*, vol 29, April 1993.

The present invention avoids these deficiencies improving performance of the active antenna.

SUMMARY OF THE INVENTION

The present invention incorporates active devices mounted on the body of a dielectric resonator antenna. In one aspect, the dielectric resonator antenna is constructed as a flip-chip device having one or more active elements integrated on its bottom surface. In another aspect, a slot feed element is formed from a metallization film on the selected surface along with any other selected active elements. In yet another aspect, the dielectric resonator antenna is a receiving antenna and in addition to the feed element the active element on it can be an amplifier. In another aspect the dielectric resonator antenna is a transmitting antenna and in addition to the feed element the active element on it can be a frequency multiplier or an upconverter. In still another aspect, the invention is especially advantageous when any of its various configurations is used at very high frequencies such as at or above W band, and more especially in the receiving mode.

DESCRIPTION

The present invention comprises a dielectric resonator antenna of the type, for example, formed as a dielectric body, such as a cube, cuboid or other parallelepiped, or of other geometric configuration such as a cylinder, in which, on a selected surface, one or more active electronic components are formed. One such active component may be a microwave slot feed element formed from a metallization film on the surface, the film also functioning as a ground plane for the antenna.

The slot feed element functions as a feed element to energize the dielectric resonator antenna in the transmit mode, or to receive the incoming signal in the receive mode and is referred to herein as a feed element with reference to either transmit or receive modes.

This invention increases the performance of transmit and receive antennas, especially at very high frequencies, for example above 75 GHz. At very high frequencies performance is limited by losses in the circuitry and transitions on and off chip. The present invention allows the incorporation of up- or down-conversion on the antenna chip, co-located with the antenna. This is especially advantageous at high millimeter wave frequencies because transitions on and off chip are extremely difficult to make without serious signal degradation. For example, wire bonds at those frequencies are electrically large and produce uncontrollable reflections. Consequently the invention is useful for any high frequency application, especially W band (75-110 GHz) and above, where it is necessary to radiate energy to and from electronic components in an efficient manner.

Figure 1:
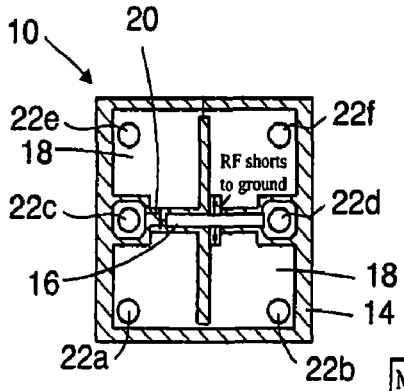
FIG. 1 is a diagrammatic bottom view of a dielectric resonator antenna having active circuit components on a bottom surface and configured for flip-chip application.
Figure 2:
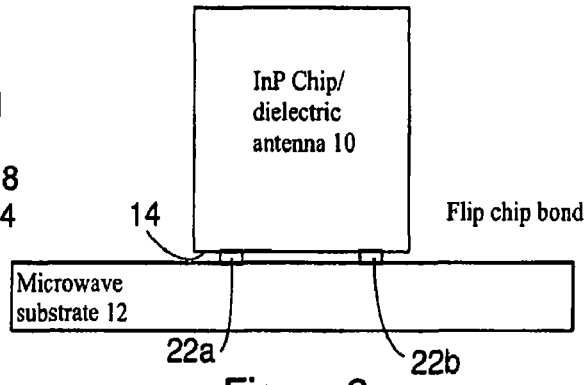
FIG. 2 is a diagrammatic side view of the active dielectric resonator antenna of FIG. 1.

FIGS. 1 and 2 respectively show diagrammatically a bottom view and a side view of exemplary implementation of an active dielectric resonator antenna as a flip-chip form of the present invention. As shown in the figures, the dielectric resonator antenna 10, for example being 20×20×20 mils, is flip-chip mounted on a microwave substrate (for example alumina) 12. The size of the dielectric resonator antenna 10 may be engineered to give a resonant mode at the desired frequency of interest, for example, 125 GHz. The dielectric resonator antenna 10 is electromagnetically coupled to metal circuitry located on the bottom surface 14 of the dielectric resonator antenna 10. A slot antenna feed element 16 is formed from a metallization film 18 and can be operated in either a transmitting or a receiving mode according to the principle of reciprocity in antenna operation. In its transmitting mode, the slot antenna feed element 16 feeds the resonant mode of the dielectric resonator antenna 10 and is preferably connected to active electronic devices, such as an InP HEMT transistor 20. Solder bumps 22*a*, 22*b*, 22*c* and 22*d* are preferably used to connect the electronics on the surface 14 to circuitry located on the microwave substrate 24, where the solder bumps 22*a* and 22*b* are connected to the source of transistor 20, solder bump 22*c* is connected to the drain of transistor 20 and solder bump 22*d* is connected to the gate of transistor 20, for example.

Solder bumps 22*a*, 22*b*, 22*e* and 22*f* are all connected to the ground plane surrounding the slot antenna and are preferably formed from metallization film 18. Due to the proximity of the edges of the feed structure 16 to the adjacent edges of the ground plane formed by metallization 18, high frequency RF signals are shorted to ground and a gate bias is applied to solder bump 22*d*. The output of the antenna is derived from solder bump 22*c*.

Additional RF components could be placed on surface 14 for example an oscillator and mixer could follow the HEMT 20 and provide down conversion to a lower frequency signal. If this occurs on the dielectric resonator antenna 10, then signal losses through the off-chip transition and subsequent circuitry will be minimized.

Figure 3:
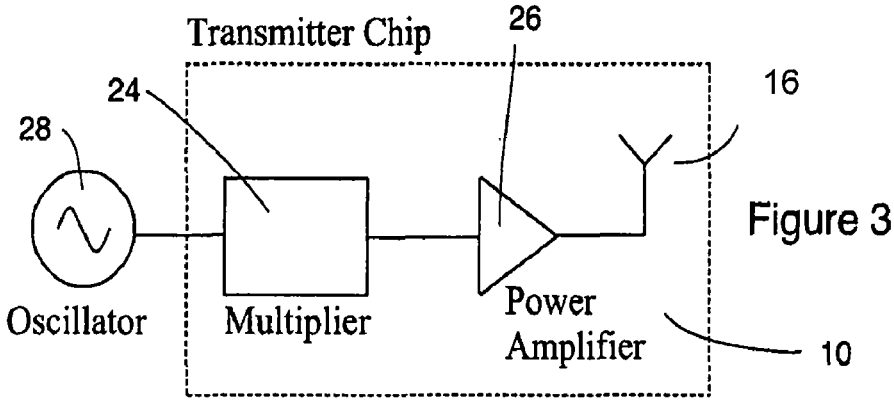
FIG. 3 is a schematic representation of a transmitter embodiment of the dielectric resonator antenna.

In a transmitting embodiment, the transmitter chip preferably contains a frequency multiplier 24 and power amplifier 26 located on the dielectric chip antenna 10, indicated with dashed box in FIG. 3, with an oscillator input source 28 located off chip 10. Any one or all of these blocks 24, 26, 28 could be located on or off the antenna chip dielectric 10, but the embodiment of FIG. 3 has the advantage of providing lower frequency transitions onto the chip 10 (by feeding the on-chip multiplier 24), thus reducing the degradation which would otherwise occur due to high frequency chip transitions at the solder bumps. The power amplifier 26 may or may not be required, depending on the application. Another possible embodiment would have the power amplifier 26 preceding the multiplier 24 and located off chip (i.e. the multiplier 24 but not the amplifier 26 is on chip in such an embodiment). That embodiment has an advantage of minimizing the on-chip high frequency circuitry. Multipliers can be made very small (e.g. Heterojunction Barrier Varactor (HBV) Diode multipliers) and may be readily integrated onto the antenna chip dielectric 10.

In a receiving embodiment, the receiver chip 10 preferably contains a Low Noise Amplifier (LNA) 36 and a downconverter 24 (also called a mixer) located on-chip, and a Local Oscillator 38 located off chip. See FIG. 4. This embodiment also has the advantage of eliminating high frequency transitions at the solder bumps, since the transitions off chip are made at the LO (Local Oscillator) and IF (Intermediate Frequency) frequencies. In place of the mixer 34 one could use an HBV diode frequency divider to reduce the frequency. This would have the advantage of significantly reducing the transition frequency (typically a factor of three from the RF input frequency), but has the disadvantage of higher conversion loss. The LNA 36 would have to be included on chip 10 for most applications since a high received signal to noise ratio (SNR) is commonly required and placing LNA 36 facilitates that. The primary advantage of this on-chip circuitry is that the received signal gets amplified by the LNA 36 immediately following reception. This significantly improves the SNR and results in a more sensitive receiver. As with the transmitter chip of FIG. 3, any one or all of these components may be included on or off chip. For example, one may wish to place the downconverter 34 off chip. This has the disadvantage of requiring a high frequency transition, yet reduces the number of active on-chip components.

Figure 4:
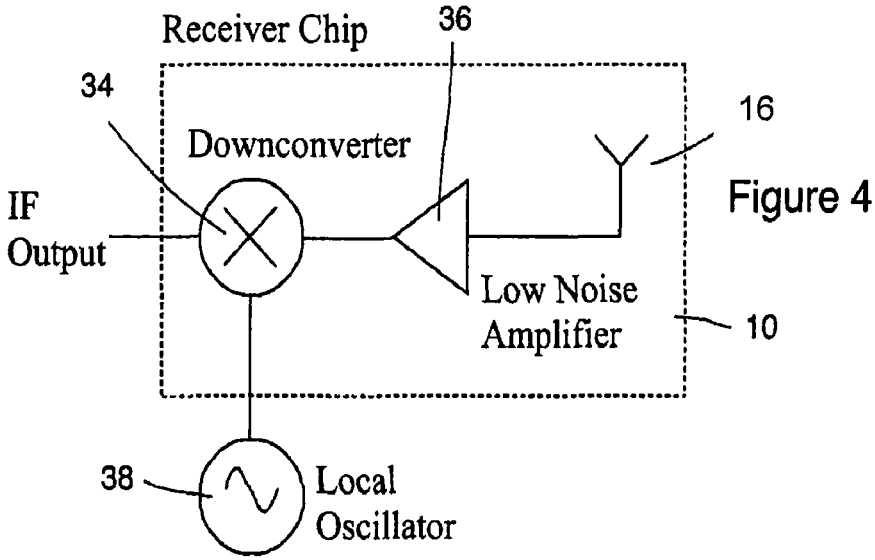
FIG. 4 is a schematic representation of a receiver embodiment of the dielectric resonator antenna.

Disposing the electronics as close to the antenna feed 16 as possible is generally more important for the receiving embodiment of FIG. 4 than the transmitting embodiment of FIG. 3. The reason for this is that receivers generally pick up very small signals and lots of noise. Additional noise gets added as one moves down the signal path away from the antenna feed 16 (due to thermal noise, lossy transitions, interference, etc.). For this reason, it is advantageous to boost the received signal as soon as possible after reception, thereby mitigating the effects of additional noise. Thus, putting the LNA 36 on the antenna chip 10 allows the signal to be boosted very soon after reception and yields a higher (better) Signal to Noise Ratio (SNR). Also, boosting the signal prior to off chip transitions, which tend to be lossy (and therefore noisy), helps improve the receiver SNR.

The disclosed dielectric resonator active antenna has dimensions that are determined, at least partly, by the operating frequency. As the frequency gets higher, the chip size must be reduced in order to achieve the desired impedance response. Thus, at higher frequencies, the active chip area gets smaller, hence limiting the area available to active circuitry. At W band frequencies (75 to 110 GHz) it is reasonable to include a simple amplifier and a passive multiplier or downconverter on chip 10. More circuitry than this is apt to require more chip area than is available using current fabrication technologies. Above W band, the amplifier circuitry will have to be kept very small to fit it on a chip.

The manufacturing processes for this dielectric antenna will be substantially the same as the existing process used for conventional W band MMIC components, appropriately modified to yield the disclosed devices.

The placement of the slot on the chip surface will affect the amount of coupling between the CPW line on the chip and the chip resonance. Generally, the slot is disposed close to the center of the chip for strong coupling, whether or not there is an active device on the chip.

The invention is useful in a wide variety of devices operating in millimeter wave ranges. For example, it can be incorporated into a millimeter wave collision avoidance or adaptive cruise control systems for automotive applications in which the ability to operate well above 77 GHz frequency allows the device to be made much smaller. It could also be used in passive imaging systems since it allows a low noise amplifier to boost the received signal immediately after receiving it, avoiding performance degradation due to off-chip transitions and circuit losses.

Figure 5:
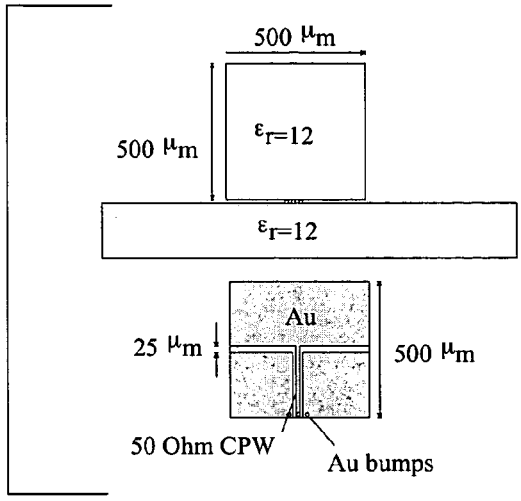
FIG. 5 shows the dimensions and material constants used for a computer simulation of the antenna.
Figure 6:
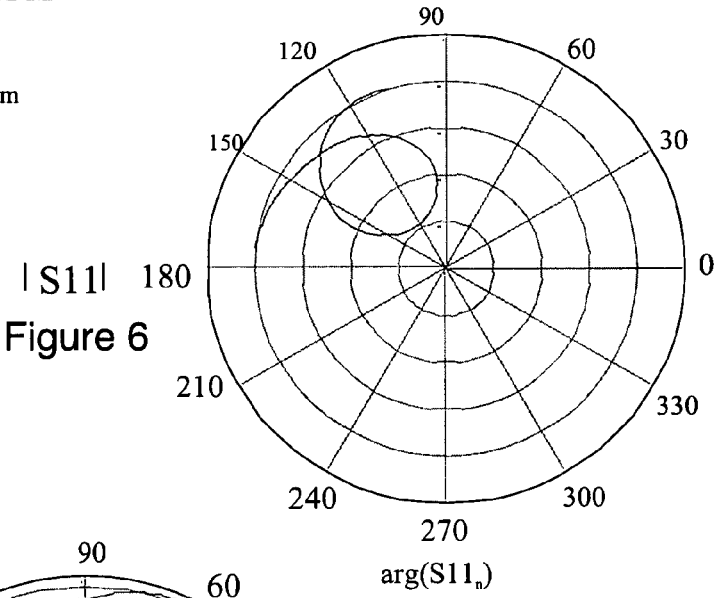
FIG. 6 shows the resulting input reflection coefficient, from 75 to 150 GHz, indicating a low Q resonance near 135 GHz for the simulated antenna.
Figure 7:
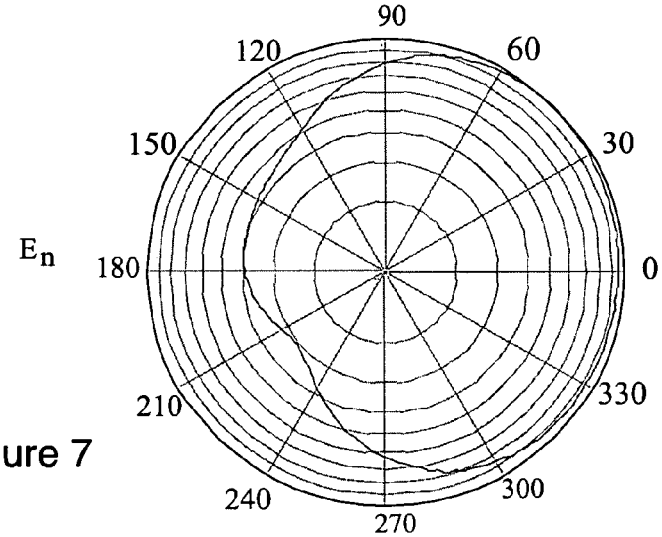
FIG. 7 shows a well-behaved radiation pattern at 125 GHz for the simulated antenna.

The disclosed flip-chip dielectric resonator antenna was modeled using commercial finite element electromagnetic simulation software (Ansoft's HFSS). FIG. 5 shows the dimensions and material constants used for the simulation. FIG. 6 shows the resulting input reflection coefficient, from 75 to 150 GHz, indicating a low Q resonance near 135 GHz. FIG. 7 shows a well-behaved radiation pattern at 125 GHz.

From the foregoing it will be appreciated that, although specific embodiments of the invention have been described herein for purposes of illustration, various modifications may be apparent to those skilled in the art without deviating from the spirit and scope of the invention. Accordingly, the invention is not limited except by the following claims including the literal interpretation and permitted scope of equivalents thereof.

The invention claimed is:

1. An active dielectric resonator antenna comprising:

a dielectric resonator antenna comprising a dielectric body having dimensions for providing a resonant mode at a desired frequency;

at least one active circuit component mounted on a selected surface of the dielectric body; and an antenna feed element formed on the selected surface of the dielectric body;

wherein the at least one active component is monolithically integrated with the antenna on the selected surface.

2. The active dielectric resonator antenna of claim 1 wherein the antenna feed element, in a transmitting mode, generates the proper resonance mode within the dielectric body of the dielectric resonator antenna or, in a receiving mode, receives the signal from the dielectric resonator antenna, said antenna feed element being co-located on the same surface as the at least one active circuit component.

3. The active dielectric resonator antenna of claim 1 wherein the dielectric resonator antenna is configured as a flip-chip device having a bottom surface and the at least one active circuit component is on the bottom surface.

4. The active dielectric resonator antenna of claim 1 wherein the at least one active circuit component includes an amplifier.

5. The active dielectric resonator antenna of claim 4 wherein the antenna feed element is a slot formed in a metallization film.

6. The active dielectric resonator antenna of claim 1 wherein the at least one active circuit component includes a frequency multiplier.

7. The active dielectric resonator antenna of claim 6 wherein the antenna feed element is a slot formed in a metallization film.

8. The active dielectric resonator antenna of claim 1 wherein the antenna feed element is a slot formed in a metallization film.

9. The active dielectric resonator antenna of claim 1 wherein the dielectric resonator antenna is operable in a frequency of at least 75 GHz.

10. The active dielectric resonator antenna of claim 1 wherein the selected surface of the dielectric body is an exterior surface of the dielectric body.

11. The active dielectric resonator antenna of claim 1 wherein the selected surface of the dielectric body is an exterior surface of the dielectric body.

12. An active dielectric resonator antenna comprising:

a dielectric resonator antenna comprising a dielectric body having dimensions for providing a resonant mode at a desired frequency;

an antenna formed on a selected surface of the dielectric body; and at least one active component monolithically integrated with the antenna and mounted on the selected surface.

13. The active dielectric resonator antenna of claim 12, wherein:

the active dielectric resonator antenna is configured as a flip-chip device having a bottom surface: and the selected surface is the bottom surface.

14. The active dielectric resonator antenna of claim 12, wherein:

the antenna, in a transmitting mode, generates the proper resonance mode within the dielectric body, or in a receiving mode receives the signal from the dielectric body, said antenna being co-located on the selected surface with the at least one active circuit component.

15. The active dielectric resonator antenna of claim 12, wherein the antenna is a slot formed in a metallization film.

16. The active dielectric resonator antenna of claim 12, wherein:

the at least one active circuit component includes an amplifier.

17. The active dielectric resonator antenna of claim 12 wherein the dielectric resonator antenna is operable in a frequency of at least 750 Hz.

18. The active dielectric resonator antenna of claim 12, wherein:

the at least one active circuit component includes a frequency multiplier.

19. An active dielectric resonator antenna, comprising:

a dielectric resonator antenna comprising a dielectric body having an exterior surface and having dimensions for providing a resonant mode at a desired frequency;

at least one active circuit component mounted on the exterior surface of the dielectric body; and a slot antenna formed on the exterior surface of the dielectric body;

wherein the at least one active circuit component and the slot antenna are monolithically integrated.

20. The active dielectric resonator antenna of claim 19, wherein the active dielectric resonator antenna is configured as a flip-chip device.

21. The active dielectric resonator antenna of claim 19, further comprising:

an antenna feed element that, in a transmitting mode, generates the proper resonance mode within the dielectric body, or that in a receiving mode receives the signal from the dielectric body, said antenna feed element being co-located on the exterior surface with the at least one active circuit component.

22. The active dielectric resonator antenna of claim 19, wherein the slot antenna is a slot formed in a metallization film.

23. The active dielectric resonator antenna of claim 19, wherein:

the at least one active circuit component includes an amplifier.

24. The active dielectric resonator antenna of claim 19, wherein the dielectric resonator antenna is operable in a frequency of at least 75 GHz.

25. The active dielectric resonator antenna of claim 19, wherein:

the at least one active circuit component includes a frequency multiplier.

* * * * *